United States Patent [19]

Tenhover et al.

[11] Patent Number: 4,609,442

[45] Date of Patent: Sep. 2, 1986

[54] ELECTROLYSIS OF HALIDE-CONTAINING SOLUTIONS WITH AMORPHOUS METAL ALLOYS

[75] Inventors: Michael A. Tenhover; Richard S. Henderson, both of Solon; Jonathan H. Harris, Shaker Heights; Robert K. Grasselli, Aurora, all of Ohio; Michael D. Ward, Newark, Del.

[73] Assignee: The Standard Oil Company, Cleveland, Ohio

[21] Appl. No.: 748,023

[22] Filed: Jun. 24, 1985

[51] Int. Cl.[4] ..... C25B 1/24

[52] U.S. Cl. ..... 204/95; 204/98; 204/128; 204/290 R; 204/290 F; 204/293

[58] Field of Search ..... 204/128, 98, 95, 293, 204/290 R, 290 F

[56] References Cited

U.S. PATENT DOCUMENTS

| | | | |
|---|---|---|---|
| 3,856,513 | 12/1974 | Chen et al. | 75/122 |
| 4,036,638 | 7/1977 | Ray et al. | 75/123 B |
| 4,339,270 | 7/1982 | Hashimoto et al. | 148/403 |
| 4,498,962 | 2/1985 | Oda | 204/129 |
| 4,544,473 | 10/1985 | Ovshinsky et al. | 204/293 |

FOREIGN PATENT DOCUMENTS

| | | | |
|---|---|---|---|
| 105453 | 1/1980 | Japan | 75/122 |
| 105454 | 1/1980 | Japan | 75/122 |
| 150148 | 4/1980 | Japan | 75/122 |
| 107439 | 12/1981 | Japan | 75/122 |
| 2023177 | 5/1979 | United Kingdom | 75/122 |

*Primary Examiner*—R. L. Andrews

*Attorney, Agent, or Firm*—Thomas P. Schur; Joseph G. Curatolo; Larry W. Evans

[57] ABSTRACT

Amorphous metal alloys have the formula $$M^1{}_aM^2{}_bM^3{}_c$$

where $M^1$ is Fe, Co, Ni, Pd and combination thereof;

$M^2$ is Ti, Zr, Hf, V, Nb, Ta and combination thereof;

$M^3$ is Rh, Os, Ir, Pt and combinations thereof;

a ranges from about 0 to 60;

b ranges from about 10 to 70; and c ranges from about 5 to 70, with the proviso that $a+b+c=100$.

These alloys have utility as anodes in electrolytic processes and a process for the generation of halogens from halide-containing solutions includes a step of conducting electrolysis of the solutions in an electrolytic cell having an amorphous metal alloy anode of the formula $$M^1{}_aM^2{}_bM^3{}_c.$$

19 Claims, No Drawings

ELECTROLYSIS OF HALIDE-CONTAINING SOLUTIONS WITH AMORPHOUS METAL ALLOYS

TECHNICAL FIELD

The present invention is directed toward the use of amorphous metal alloys which can be considered metallic and are electrically conductive. Amorphous metal alloy materials have become of interest in recent years due to their unique combinations of mechanical, chemical and electrical properties which are specially well suited for newly emerging applications. Amorphous metal materials have compositionally variable properties, high hardness and strength, flexibility, soft magnetic and ferroelectronic properties, very high resistance to corrosion and wear, unusual alloy compositions, and high resistance to radiation damage. These characteristics are desirable for applications such as low temperature welding alloys, magnetic bubble memories, high field superconducting devices and soft magnetic materials for power transformer cores.

Given their resistance to corrosion, the amorphous metal alloys disclosed herein are particularly useful as cathodes or anodes in various electrochemical processes, two in particular including as electrodes in halogen evolution processes and as oxygen anodes, respectively. Other uses as electrodes include the production of fluorine, chlorate, and perchlorate, electrochemical fluorination of organic compounds, electrofiltration and hydrodimerization of acrylonitrile to adiponitrile. These alloys can also be employed as hydrogen permeable membranes.

BACKGROUND ART

The unique combination of properties possessed by amorphous metal alloy materials may be attributed to the disordered atomic structure of amorphous materials which ensures that the material is chemically homogeneous and free from the extended defects that are known to limit the performance of crystalline materials.

Generally, amorphous materials are formed by rapidly cooling the material from a molten state. Such cooling occurs at rates on the order of $10^{6°}$ C./second. Processes that provide such cooling rates include sputtering, vacuum evaporation, plasma spraying and direct quenching from the liquid state. Direct quenching from the liquid state has found the greatest commercial success inasmuch as a variety of alloys are known that can be manufactured by this technique in various forms such as thin films, ribbons and wires.

U.S. Pat. No. 3,856,513 describes novel metal alloy compositions obtained by direct quenching from the melt and includes a general discussion of this process. The patent describes magnetic amorphous metal alloys formed by subjecting the alloy composition to rapid cooling from a temperature above its melting temperature. A stream of the molten metal was directed into the nip of rotating double rolls maintained at room temperature. The quenched metal, obtained in the form of a ribbon, was substantially amorphous as indicated by X-ray diffraction measurements, was ductile, and had a tensile strength of about 350,000 psi (2415 MPa).

U.S. Pat. No. 4,036,638 describes binary amorphous alloys of iron or cobalt and boron. The claimed amorphous alloys were formed by a vacuum melt-casting process wherein molten alloy was ejected through an orifice and against a rotating cylinder in a partial vacuum of about 100 millitorr. Such amorphous alloys were obtained as continuous ribbons and all exhibit high mechanical hardness and ductility.

U.S. Pat. No. 4,264,358 discloses amorphous superconducting glassy alloys comprising one or more Group IVB, VB, VIB, VIIB or VIII transition metals and one or more metalloids such as B, P, C, N, Si, Ge, or Al. The alloys are stated to have utility as high field superconducting magnet materials.

U.S. Pat. No. 4,498,962 discloses an amorphous metal alloy anode for the electrolysis of water which comprises a coating of three electrochemically active materials X, Y and Z on an electrode substrate where X is nickel, cobalt and mixtures, Y is aluminum, zinc, magnesium and silicon and Z is rhenium and the noble metals. The anodes were reported to have low oxygen overvoltages.

The amorphous metal alloys described hereinabove have not been suggested for usage as electrodes in electrolytic processes in distinction from the alloys utilized for practice of the present invention. With respect to processes for chlorine evolution from sodium chloride solutions, certain palladium-phosphorus based metal alloys have been prepared and described in U.S. Pat. No. 4,339,270 which discloses a variety of ternary amorphous metal alloys consisting of 10 to 40 atomic percent phosphorus and/or silicon and 90 to 60 atomic percent of two or more of palladium, rhodium and platinum. Additional elements that can be present include titanium, zirconium, niobium, tantalum and/or iridium. The alloys can be used as electrodes for electrolysis and the patent reports high corrosion resistance in the electrolysis of halide solutions.

The anodic characteristics of these alloys have been studied by three of the patentees, M. Hara, K. Hashimoto and T. Masumoto and reported in various journals. One such publication entitled "The Anodic Polarization Behavior of Amorphous Pd-Ti-P Alloys in NaCl Solution" *Electrochimica Acta,* 25, pp. 1215–1220 (1980) describes the reaction of palladium chips and phosphorus at elevated temperatures to form palladium phosphide which is then melted with titanium. The resulting alloy was then formed into ribbons 10 to 30 microns in thickness by the rotating wheel method.

"Anodic Characteristics of Amorphous Ternary Palladium-Phosphorus Alloys Containing Ruthenium, Rhodium, Iridium, or Platinum in a Hot Concentrated Sodium Chloride Solution", reported in the *Journal of Applied Electrochemistry* 13, pp. 295–306 (1983) describes the entitled alloys, again prepared by the rotating wheel method from the molten state. Palladium-silicon alloys were also prepared and evaluated but were found to be unsatisfactory as anodes. The reported anode alloys were found to be more corrosion resistant and had a higher chlorine activity and lower oxygen activity than DSA.

Lastly, "Anodic Characteristics of Amorphous Palladium-Iridium-Phosphorus Alloys in a Hot Concentrated Sodium Chloride Solution" reported in *Journal of Non-Crystalline Solids,* 54, pp. 85–100 (1983) describes such alloys also prepared by the rotating wheel method. Again, moderate corrosion resistance, high chlorine activity and low oxygen activity were reported.

The authors found that the electrocatalytic selectivity of these alloys was significantly higher than that of the known dimensionally stable anodes (DSA) consisting of an oxide mixture of ruthenium, and titanium supported by metallic titanium. A disadvantage of DSA is that the electrolysis of sodium chloride is not entirely selective for chlorine and some oxygen is produced. The alloys reported were less active for oxygen evolution than DSA.

Dimensionally stable anodes are described in the following three early U.S. patents. U.S. Pat. No. 3,234,110 calls for an electrode comprising titanium or a titanium alloy core, coated at least partially with titanium oxide which coating is, in turn, provided with a noble metal coating such as platinum, rhodium, iridium and alloys thereof.

U.S. Pat. No. 3,236,756 discloses an electrode comprising a titanium core, a porous coating thereon of platinum and/or rhodium and a layer of titanium oxide on the core at the places where the coating is porous.

U.S. Pat. No. 3,771,385 is directed toward electrodes comprising a core of a film forming metal consisting of titanium, tantalum, zirconium, niobium and tungsten, carrying an outside layer of a metal oxide of at least one platinum metal from the group consisting of platinum, iridium, rhodium, palladium, ruthenium and osmium.

All three of these electrodes have utility in electrolytic processes although unlike the present invention, none are amorphous metals. Thus, despite the state of the art in amorphous metal alloys, there has not been a teaching heretofore of the novel amorphous metal alloys disclosed herein or likewise, their use in various electrochemical processes.

SUMMARY OF THE INVENTION

The process of the present invention is directed toward the production of halogens and comprises the step of conducting electrolysis of halide-containing solutions in an electrolytic cell having an amorphous metal alloy anode of the formula $$M^1{}_aM^2{}_bM^3{}_c$$

where $M^1$ is Fe, Co, Ni, Pd and combinations thereof;
$M^2$ is Ti, Zr, Hf, V, Nb, Ta and combinations thereof;
$M^3$ is Rh, Os, Ir, Pt and combinations thereof;
a ranges from about 0 to 60;
b ranges from about 10 to 70; and
c ranges from about 5 to 70, with the proviso that $a+b+c=100$.

Characteristic of these amorphous metal alloy anodes is that they are generally based upon Fe and the other $M^1$ metals and need contain only small amounts of electrocatalytically active elements such as Pt and Ir and an amorphous metal alloy host. Thus, they consist of relatively inexpensive materials, representing a significant cost advantage over existing amorphous metal alloys that are electrochemically active.

PREFERRED MODE FOR CARRYING OUT THE INVENTION

The amorphous metal alloy anodes of the present invention are useful as electrodes as they exhibit good electrochemical activity and corrosion resistance. They differ from previously described amorphous metal alloy anodes based upon Pt and Ir in that they need only small amounts of these electrocatalytically active elements and can contain relatively greater amounts of inexpensive elements such as Fe, Co and Ni.

The process of the present invention, as noted hereinabove, employs a novel amorphous metal alloy anode having the formula $$M^1{}_aM^2{}_bM^3{}_c$$

where $M^1$ is Fe, Co, Ni, Pd and combinations thereof;
$M^2$ is Ti, Zr, Hf, V, Nb, Ta and combinations thereof;
$M^3$ is Rh, Os, Ir, Pt and combinations thereof;
a ranges from about 0 to 60;
b ranges from about 10 to 70; and
c ranges from about 5 to 70, with the proviso that $a+b+c=100$.

The foregoing metal alloy anodes can be binary or ternary with $M^2$ being mandatory and $M^1$ or $M^3$ optional. Several preferred combinations of elements include Ti/Pt, Fe/Ti/Pt, Fe/Ta/Pt, Zr,Pt and Fe/Ti/Pd/Ir. The foregoing list is not to be construed as limiting but merely exemplary.

These alloys can be prepared by any of the standard techniques for fabricating amorphous metal alloys. Thus, any physical or chemical method, such as electron beam evaporation, chemical and/or physical decomposition, ion-cluster, ion plating, liquid quench or R.F. and D.C. sputtering process can be utilized. The amorphous alloy can be either solid, powder or thin film form, either free standing or attached to a substrate. Trace impurities such as S, Se, Te and Ar are not expected to be seriously detrimental to the preparation and performance of the materials. The only restriction on the environment in which the materials are prepared or operated is that the temperature during both stages be lower than the crystallization temperature of the amorphous metal alloy.

The amorphous metal alloys disclosed herein are particularly suitable as coatings on substrate metals which are then employed as anodes in various electrochemical processes. At least one preferred substrate metal for use as the anode is titanium although other metals and various non-metals are also suitable. The substrate is useful primarily to provide support for the amorphous metal alloys and therefore can also be a non-conductor or semi-conductor material. The coating is readily deposited upon the substrate by sputtering, as was done for the examples presented hereinbelow. Coating thicknesses are not crucial and may range broadly, for example, up to about 100 microns although other thicknesses are not necessarily precluded so long as they are practical for their intended use. A useful thickness, exemplified in the work hereinbelow, is 3000 Å.

As will be appreciated, the desired thickness is somewhat dependent upon the process of preparation of the anode and somewhat upon the intended use. Thus, a free-standing or non-supported anode, as prepared by liquid quenching, may have a thickness of approximately 100 microns. Or an amorphous alloy anode can be prepared by pressing the amorphous alloy, in powder form, into a predetermined shape and can also be thick enough to be free-standing. Where a sputtering process is employed, relatively thin layers can be deposited and these would be preferably supported by a suitable substrate, as noted hereinabove. Thus, it is to be understood that the actual anode employed in the present invention is the amorphous metal alloy whether supported or unsupported. Where a very thin layer is employed, a support may be convenient or even necessary to provide integrity.

Irrespective of the use of the amorphous metal alloys, as a coating or a solid product, the alloys are substantially amorphous. The term "substantially" as used herein in reference to the amorphous metal alloy means that the metal alloys are at least fifty percent amorphous. Preferably the metal alloy is at least eighty percent amorphous and most preferably about one hundred percent amorphous, as indicated by X-ray diffraction analysis.

As stated hereinabove, the amorphous metal alloys of the present invention have a plurality of uses including, for instance, as anodes in electrolytic cells for the generation of halogens and related halogen products.

With respect to the generation of halogen, a wide variety of halide-containing solutions can be employed such as, for instance, sodium chloride, potassium chloride, lithium chloride, cesium chloride, hydrogen chloride, from chloride, zinc chloride, copper chloride and the like. Products in addition to chlorine can also include, for instance, chlorates, perchlorates and other chlorine oxides. Similarly, other halides can be present, in lieu of chlorides, and thus, other products generated. The present invention is, therefore, not limited by use in any specific halide-containing solution.

The foregoing processes of electrolysis can be conducted at standard conditions known to those skilled in the art. These include voltages in the range of from about 1.10 to 2.50 volts (SCE) and current densities of from about 10 to 2000 mA/cm$^2$. Electrolyte solutions (aqueous) are generally at a pH of 1 to 6 and molar concentrations of from about 0.5 to 4M. Temperature can range between about 0° to 100° C. with a range of 60° to 90° C. being preferred. The cell configuration is not crucial to practice of the process and therefore is not a limitation of the present invention.

In the examples which follow, four amorphous metal alloys were prepared via radio frequency sputtering in argon gas. A 2" Research S-Gun, manufactured by Sputtered Films, Inc. was employed. As is known, DC sputtering can also be employed. For each of the examples, a titanium substrate was positioned to receive the deposition of the sputtered amorphous alloy. The composition at each alloy was verified by X-ray analysis and was amorphous to X-ray analysis. The distance between the target and the substrate in each instance was approximately 10 cm.

TABLE I

| Amorphous Metal Alloy Halogen Electrodes | |
|---|---|
| Example No. | Alloy |
| 1 | $Fe_{55}Ta_{40}Pt_5$ |
| 2 | $Ti_{70}Pt_{30}$ |
| 3 | $Zr_{60}Pt_{40}$ |
| 4 | $Fe_{20}Ti_{10}Pd_{35}Ir_{35}$ |

The four alloys reported in Table I were each separately employed in a 4M NaCl solution for the evolution of chlorine when an anodic bias was applied in the solution. Electrolysis conditions included pH 2.0; T=80° C. and current density, 10 mA/cm$^2$. Voltages were recorded for each alloy anode and have been reported in Table II.

TABLE II

| Generation of Chlorine with Amorphous Metal Alloy Anodes | |
|---|---|
| Example | Voltage (SCE) |
| 1 | 1.30 |
| 2 | 1.19 |
| 3 | 1.16 |
| 4 | 1.14 |

The low voltages reported in Table II should demonstrate the satisfactory use of the amorphous metal alloy anodes of this invention as electrodes in processes for the production of chlorine. Although these amorphous metal alloy anodes have been utilized in conjunction with one exemplary electrolyte solution, it will readily be appreciated by those skilled in the art that other electrolyte solutions could be substituted therefor with a variety of products being obtained.

It is to be understood that the foregoing examples have been provided to enable those skilled in the art to have representative examples by which to evaluate and practice the process and that these examples should not be construed as any limitation on the scope of this invention. Inasmuch as the composition of the amorphous metal alloys employed in the process can be varied within the scope of the total specification disclosure, neither the particular $M^1$, $M^2$ or $M^3$ components nor the relative amounts of the components in the binary and ternary alloys exemplified herein shall be construed as limitations of the invention.

Thus, it is believed that any of the variables disclosed herein can readily be determined and controlled without departing from the spirit of the invention herein disclosed and described. Moreover, the scope of the invention shall include all modifications and variations that fall within the scope of the attached claims.

We claim:

1. A process for the generation of halogens from halide-containing solutions comprising the step of:

conducting electrolysis of said solutions in an electrolytic cell having an amorphous metal alloy anode having the formula $$M^1{}_aM^2{}_bM^3{}_c$$

where $M^1$ is Fe, Co, Ni, Pd and combinations thereof;

$M^2$ is Ti, Zr, Hf, V, Nb, Ta and combinations thereof;

$M^3$ is Rh, Os, Ir, Pt and combinations thereof;

a ranges from about 0 to 60;

b ranges from 10 to 70; and c ranges from about 5 to 70, with the proviso that $a+b+c=100$.

2. A process, as set forth in claim 1, wherein said amorphous metal alloy anode is at least 50 percent amorphous.

3. A process, as set forth in claim 1, wherein said amorphous metal alloy anode is at least 80 percent amorphous.

4. A process, as set forth in claim 1, wherein said amorphous metal alloy anode is about 100 percent amorphous.

5. A process, as set forth in claim 1, wherein said halide is chloride.

6. A process, as set forth in claim 5, which produces products selected from the group consisting of chlorine, chlorates, perchlorates and other chlorine oxides upon electrolysis of said chloride-containing solutions therewith.

7. A process, as set forth in claim 1, wherein said halide-containing solution comprises sodium chloride solutions.

8. A process, as set forth in claim 7, wherein chlorine is generated at said anode substantially free of oxygen.

9. A process, as set forth in claim 1, wherein said amorphous metal alloy anode comprises Fe, Ta and Pt.

10. A process, as set forth in claim 9, wherein said amorphous metal alloy anode comprises $Fe_{55}Ta_{40}Pt_5$.

11. A process, as set forth in claim 1, wherein said amorphous metal alloy anode comprises Ti and Pt.

12. A process, as set forth in claim 11, wherein said amorphous metal alloy anode comprises $Ti_{70}Pt_{30}$.

13. A process, as set forth in claim 1, wherein said amorphous metal alloy anode comprises Zr and Pt.

14. A process, as set forth in claim 13, wherein said amorphous metal alloy anode comprises $Zr_{60}Pt_{40}$.

15. A process as set forth in claim 1, wherein said amorphous metal alloy anode comprises Fe, Ti, Pd and Ir.

16. A process, as set forth in claim 15, wherein said amorphous metal alloy anode comprises $Fe_{20}Ti_{10}Pd_{35}Ir_{35}$.

17. A process, as set forth in claim 1, wherein said amorphous metal alloy anode has a thickness of up to about 100 microns.

18. A process, as set forth in claim 1, wherein electrolysis is conducted at a voltage range of from about 1.10 to 2.50 volts (SCE) and current densities of from about 10 to 2000 $mA/cm^2$.

19. A process, as set forth in claim 1, wherein electrolysis is conducted at a temperature range of from about 0° to about 100° C.

* * * * *